US011339999B2

(12) United States Patent
Aoki et al.

(10) Patent No.: US 11,339,999 B2
(45) Date of Patent: May 24, 2022

(54) COMPRESSOR AND ACCUMULATOR WITH MULTIPLE SUCTION TUBES FOR A REFRIGERATION CYCLE DEVICE

(71) Applicant: Toshiba Carrier Corporation, Kawasaki (JP)

(72) Inventors: Toshimasa Aoki, Fuji (JP); Koji Satodate, Fuji (JP); Tadayuki Yamazaki, Fuji (JP); Takuya Hirayama, Fuji (JP)

(73) Assignee: Toshiba Carrier Corporation, Kawasaki (JP)

( * ) Notice: Subject to any disclaimer, the term of this patent is extended or adjusted under 35 U.S.C. 154(b) by 51 days.

(21) Appl. No.: 16/916,319

(22) Filed: Jun. 30, 2020

(65) Prior Publication Data

US 2020/0333055 A1 Oct. 22, 2020

Related U.S. Application Data

(63) Continuation of application No. PCT/JP2018/037074, filed on Oct. 3, 2018.

(30) Foreign Application Priority Data

Jan. 18, 2018 (JP) ..... JP2018-006768

(51) Int. Cl.
*F25B 31/02* (2006.01)
*F25B 13/00* (2006.01)

(52) U.S. Cl.
CPC ..... *F25B 31/026* (2013.01); *F25B 13/00* (2013.01)

(58) Field of Classification Search
CPC .... F24F 11/36; F25B 2500/222; F25B 49/005
See application file for complete search history.

(56) References Cited

U.S. PATENT DOCUMENTS

2008/0267804 A1 10/2008 Morozumi
2009/0081053 A1 3/2009 Ueda et al.
(Continued)

FOREIGN PATENT DOCUMENTS

CN 104838145 A 8/2015
CN 104948461 A 9/2015
(Continued)

OTHER PUBLICATIONS

International Search Report dated Dec. 11, 2018 in PCT/JP2018/037074 filed Oct. 3, 2018, 2 pages.
(Continued)

*Primary Examiner* — Henry T Crenshaw
(74) *Attorney, Agent, or Firm* — Oblon, McClelland, Maier & Neustadt, L.L.P.

(57) ABSTRACT

A compressor includes three suction pipes. A first center of a first suction pipe, a second center of a second suction pipe, and a third center of a third suction pipe are positioned at vertices of a triangle. A first distance between the first center and a center of a compressor main body is smaller than a second distance between the second center and the center of the compressor main body and a third distance between the third center and the center of the compressor main body. A second flow path cross section and a third flow path cross section are positioned on opposite sides of a center connection line sandwiched therebetween. The first suction pipe is connected to a suction port which is at an uppermost position among three suction ports provided in a case.

6 Claims, 10 Drawing Sheets

(56) References Cited

U.S. PATENT DOCUMENTS

| | | | | |
|---|---|---|---|---|
| 2016/0018136 | A1* | 1/2016 | Hirayama | F04C 29/0085 62/401 |
| 2019/0078795 | A1* | 3/2019 | Kim | F25B 13/00 |
| 2019/0178543 | A1* | 6/2019 | McKim | F25B 13/00 |
| 2020/0333055 | A1* | 10/2020 | Aoki | F25B 43/006 |

FOREIGN PATENT DOCUMENTS

| | | | |
|---|---|---|---|
| CN | 106415015 | A | 2/2017 |
| CN | 106568225 | A | 4/2017 |
| JP | 3-81594 | A | 4/1991 |
| JP | 2008-274844 | A | 11/2008 |
| JP | 2016-48032 | A | 4/2016 |
| KR | 2002-0011250 | A | 2/2002 |
| WO | WO 2005/124156 | A1 | 12/2005 |

OTHER PUBLICATIONS

Combined Chinese Office Action and Search Report dated Aug. 3, 2021 in Chinese Patent Application No. 201880076534.9 (with English translation of Search Report only), 10 pages.

* cited by examiner

COMPRESSOR AND ACCUMULATOR WITH MULTIPLE SUCTION TUBES FOR A REFRIGERATION CYCLE DEVICE

CROSS-REFERENCE TO RELATED APPLICATIONS

This is a Continuation Application of International Application No. PCT/JP2018/037074, filed on Oct. 3, 2018, which is based upon and claims the benefit of priority from Japanese Patent Application No. 2018-006768, filed on Jan. 18, 2018; the entire contents of which are incorporated herein by reference.

FIELD

Embodiments described herein relate generally to a compressor and a refrigeration cycle device.

BACKGROUND

A refrigeration cycle device includes a compressor which compresses a gaseous refrigerant. The compressor includes a compressor main body and an accumulator. The accumulator performs gas-liquid separation of a refrigerant and supplies a gaseous refrigerant to the compressor main body.

Compressors are required to be made compact.

DETAILED DESCRIPTION

Figure 1:
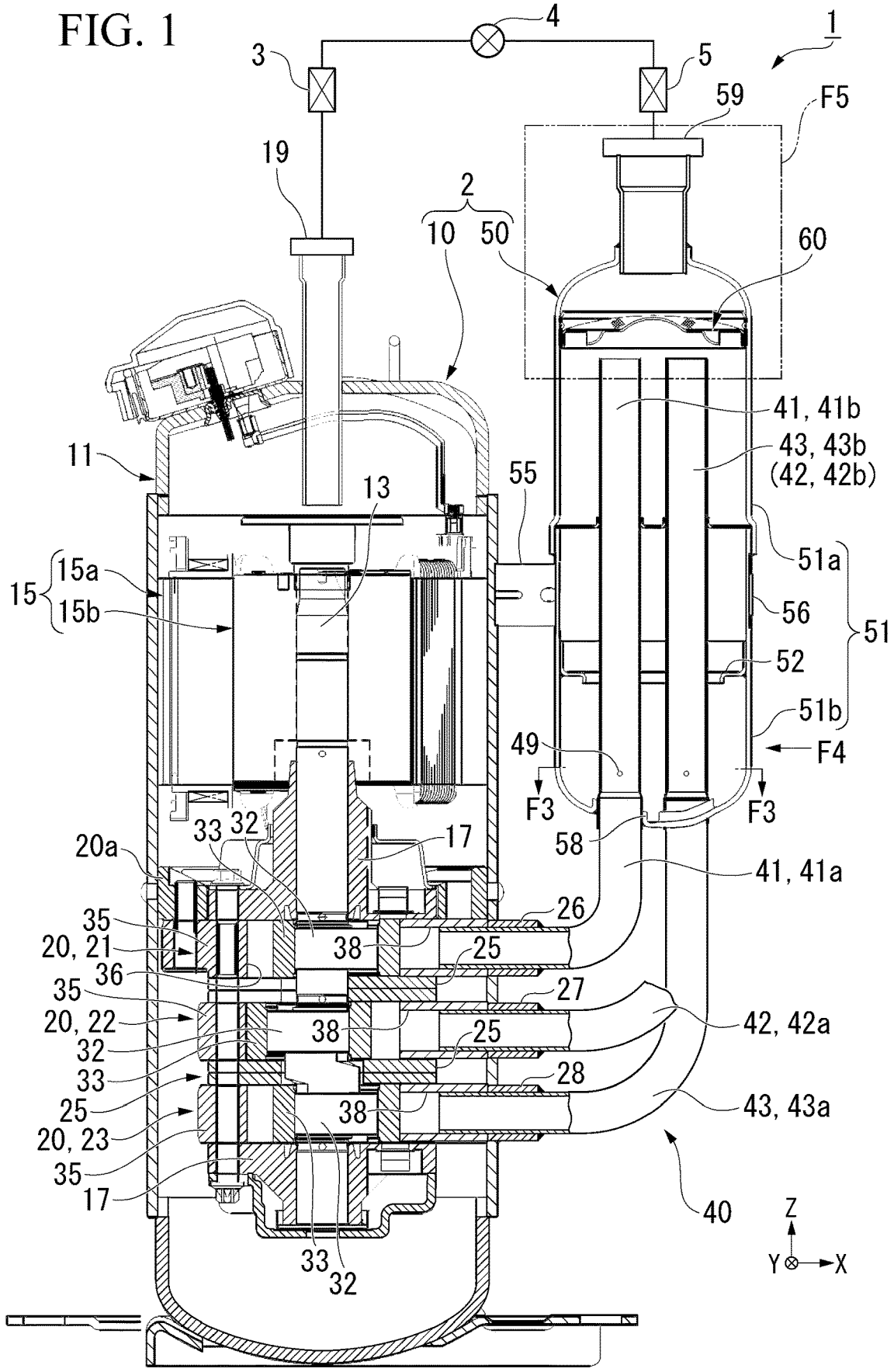
FIG. 1 is a schematic configuration view of a refrigeration cycle device including a cross-sectional view of a compressor of a first embodiment.

In embodiments, a compressor includes a compressor main body, an accumulator, and three suction pipes. The compressor main body houses a plurality of compression mechanism units and an electric motor unit driving the plurality of compression mechanism units in a case. The accumulator is supported by the compressor main body and includes a refrigerant introduction part at an upper portion thereof. Three suction pipes penetrate a bottom portion of the accumulator, have one end sides which open inside the accumulator, and have the other end sides connected to three suction ports provided in the case. The three suction pipes are a first suction pipe, a second suction pipe, and a third suction pipe. The three suction pipes are disposed so that a first center of a first flow path cross section of the first suction pipe, a second center of a second flow path cross section of the second suction pipe, and a third center of a third flow path cross section of the third suction pipe are positioned at vertices of a triangle in a portion penetrating the bottom portion of the accumulator when viewed from above the accumulator. The first suction pipe is disposed so that a first distance between the first center and a center of the compressor main body is smaller than a second distance between the second center and the center of the compressor main body and a third distance between the third center and the center of the compressor main body. The first suction pipe is disposed so that the first flow path cross section overlaps a center connection line passing through the center of the compressor main body and a center of the accumulator when viewed from above the accumulator. The second suction pipe and the third suction pipe are disposed so that the second flow path cross section and the third flow path cross section are positioned on opposite sides of the center connection line sandwiched therebetween when viewed from above the accumulator. The other end side of the first suction pipe is connected to a suction port which is at an uppermost position among the three suction ports.

Hereinafter, a compressor 2 and a refrigeration cycle device 1 of the embodiment will be described with reference to the drawings.

In the present application, an X direction, a Y direction, and a Z direction are defined as follows. The X direction is a direction in which a compressor main body 10 and an accumulator 50 are aligned, and a +X direction is a direction from the compressor main body 10 toward the accumulator 50. The Z direction is a direction parallel to a central axis of the compressor main body 10, and a +Z direction is a direction from a compression mechanism unit 20 toward an electric motor unit 15. The Y direction is a direction perpendicular to the X direction and the Z direction. The X direction and the Y direction may be, for example, horizontal directions. The Z direction may be, for example, a vertical direction, and the +Z direction may be, for example, vertically upward.

The refrigeration cycle device 1 will be briefly described.

FIG. 1 is a schematic configuration view of the refrigeration cycle device 1 including a cross-sectional view of the compressor 2 of the present embodiment.

As illustrated in FIG. 1, the refrigeration cycle device 1 includes the compressor 2, a condenser 3 connected to the compressor 2 as a radiator, an expansion device 4 connected to the condenser 3, and an evaporator 5 connected to the expansion device 4 as a heat absorber.

The compressor 2 is a so-called rotary type compressor. The compressor 2, for example, compresses a low-pressure gaseous refrigerant (fluid) taken into the inside into a high-temperature and high-pressure gaseous refrigerant. A specific configuration of the compressor 2 will be described below.

The condenser 3 radiates heat from the high-temperature and high-pressure gaseous refrigerant discharged from the compressor 2 to convert the high-temperature and high-pressure gaseous refrigerant into a high-pressure liquid refrigerant.

The expansion device 4 reduces a pressure of the high-pressure liquid refrigerant sent from the condenser 3 to convert the high-pressure liquid refrigerant into a low-temperature and low-pressure liquid refrigerant.

The evaporator 5 evaporates the low-temperature and low-pressure liquid refrigerant sent from the expansion device 4 to convert the low-temperature and low-pressure liquid refrigerant into a low-pressure gaseous refrigerant. In the evaporator 5, evaporation of the low-pressure liquid refrigerant takes evaporation heat from the surroundings, and thus the surroundings are cooled. Further, the low-pressure gaseous refrigerant that has passed through the evaporator 5 is taken into the compressor 2 described above.

As described above, in the refrigeration cycle device 1 of the present embodiment, a refrigerant serving as a working fluid circulates while changing its phase between a gaseous refrigerant and a liquid refrigerant, in which heat is radiated in the process of changing phase from the gaseous refrigerant to the liquid refrigerant, and heat is absorbed in the process of changing phase from the liquid refrigerant to the gaseous refrigerant. Thus, heating, cooling, or the like is performed by utilizing such heat radiation and heat absorption.

First Embodiment

The compressor 2 of a first embodiment will be described.

The compressor 2 includes the compressor main body 10 and the accumulator 50.

The compressor main body 10 includes a shaft 13, the electric motor unit 15 which rotates the shaft 13, a plurality of compression mechanism units 20 which compress a gaseous refrigerant by rotation of the shaft 13, and a cylindrical case 11 which houses the shaft 13, the electric motor unit 15 and the compression mechanism unit 20.

The shaft 13 is disposed along the central axis of the compressor main body 10.

The electric motor unit 15 is disposed in the +Z direction of the shaft 13. The electric motor unit 15 includes a stator 15*a* and a rotor 15*b*. The stator 15*a* is fixed to an inner circumferential surface of the case 11. The rotor 15*b* is fixed to an outer circumferential surface of the shaft 13. The electric motor unit 15 rotates the shaft 13 inside the case 11.

The case 11 is formed in a cylindrical shape with both end portions closed. The case 11 includes a discharge part 19 at an upper end portion. The discharge part 19 is formed by a pipe and is disposed along a central axis of the case 11. The discharge part 19 has a discharge port at an upper end portion. The discharge part 19 discharges the gaseous refrigerant inside the case 11 from the discharge port.

The plurality of compression mechanism units 20 are disposed in the −Z direction of the shaft 13. The plurality of compression mechanism units 20 may include three compression mechanism units 20 including, for example, a first compression mechanism unit 21, a second compression mechanism unit 22, and a third compression mechanism unit 23. The first compression mechanism unit 21, the second compression mechanism unit 22, and the third compression mechanism unit 23 are disposed to be aligned in that order from the +Z direction to the −Z direction. The first compression mechanism unit 21 is at an uppermost position in the +Z direction among the plurality of compression mechanism units 20. Hereinafter, a configuration of the first compression mechanism unit 21 will be described as a representative. The configurations of the second compression mechanism unit 22 and the third compression mechanism unit 23 are the same as that of the first compression mechanism unit 21 except for a direction of eccentricity of an eccentric part 32.

The first compression mechanism unit 21 includes the eccentric part 32, a roller 33, a cylinder 35, a bearing 17, and a partition plate 25.

The eccentric part 32 is formed integrally with the shaft 13 in a columnar shape. When viewed from the +Z direction, a center of the eccentric part 32 is eccentric from a central axis of the shaft 13.

The roller 33 is formed in a cylindrical shape and is disposed along an outer circumference of the eccentric part 32.

The cylinder 35 is fixed to a frame 20*a*, and an outer circumferential surface of the frame 20*a* is fixed to an inner circumferential surface of the case 11. The cylinder 35 includes a cylinder chamber 36, a vane (not illustrated), and a suction hole 38. The cylinder chamber 36 houses the eccentric part 32 and the roller 33 inside. The vane is housed in a vane groove formed in the cylinder 35 and can advance into and retreat from an inside of the cylinder chamber 36. The vane is biased such that a distal end portion thereof is brought into contact with an outer circumferential surface of the roller 33. The vane, together with the eccentric part 32 and the roller 33, partitions the inside of the cylinder chamber 36 into a suction chamber and a compression chamber. The suction hole 38 is formed from an outer circumferential surface of the cylinder 35 in contact with the inner circumferential surface of the case 11 to the cylinder chamber 36. The suction hole 38 introduces a gaseous refrigerant into the suction chamber of the cylinder chamber 36. A first suction port 26 facing the suction hole 38 is provided in the case 11.

Similarly to the first suction port 26, a second suction port 27 is provided to face the suction hole 38 of the second compression mechanism unit 22, and a third suction port 28 is provided to face the suction hole 38 of the third compression mechanism unit 23.

The bearing 17 and the partition plate 25 are disposed on both sides of the cylinder 35 in the Z direction. The bearing 17 and the partition plate 25 close both end portions of the cylinder chamber 36 in the Z direction. The bearing 17 and the partition plate 25 have a discharge hole. The discharge hole discharges a gaseous refrigerant compressed in the compression chamber of the cylinder chamber 36 to the inside of the case 11.

An operation of the first compression mechanism unit 21 will be described.

When the electric motor unit 15 rotates the shaft 13, the eccentric part 32 and the roller 33 eccentrically rotate inside the cylinder chamber 36. When the roller 33 rotates eccentrically, a gaseous refrigerant is suctioned into the suction chamber of the cylinder chamber 36, and the gaseous refrigerant in the compression chamber is compressed. The compressed gaseous refrigerant is discharged from the discharge hole of the bearing 17 and the partition plate 25 to the inside of the case 11. The gaseous refrigerant inside the case 11 is discharged from the discharge part 19 to the outside of the case 11.

The accumulator 50 will be described.

The accumulator 50 includes a case 51, a plurality of suction pipes 40, and a strainer plate 60. The accumulator 50 separates an introduced refrigerant into a gaseous refrigerant and a liquid refrigerant. The liquid refrigerant is stored in a bottom portion of the case 51. The gaseous refrigerant is supplied to the compressor main body 10 through the suction pipes 40.

The case 51 is formed in a cylindrical shape with both end portions closed. The case 51 is formed by connecting a first case 51*a* in the +Z direction and a second case 51*b* in the −Z direction. Through holes 58 through which the plurality of suction pipes 40 pass are formed in the bottom portion of the case 51. The case 51 is supported by the compressor main body 10 via a bracket 55 and a belt 56 (see FIG. 2).

The case 51 includes an introduction part 59 and a retainer 52.

The introduction part 59 is provided at an upper end portion of the case 51. The introduction part 59 is formed by a pipe and is disposed along a central axis of the case 51. The introduction part 59 has an introduction port of a refrigerant at the upper end portion. The introduction part 59 introduces a refrigerant into the case 51 from the introduction port.

The retainer 52 is provided inside the case 51. The retainer 52 is formed in a ring shape, and an outer circumferential surface thereof is fixed to an inner circumferential surface of the case 51. The retainer 52 increases rigidity of the case 51.

The plurality of suction pipes 40 will be described in detail.

The plurality of suction pipes 40 are three suction pipes including a first suction pipe 41, a second suction pipe 42, and a third suction pipe 43. The three suction pipes 41, 42, and 43 are provided through a through hole 58 formed in the bottom portion of the case 51. The three suction pipes 41, 42, and 43 are formed by connecting external suction pipes 41*a*, 42*a*, and 43*a* disposed outside the case 51 and internal suction pipes 41*b*, 42*b*, and 43*b* disposed inside the case 51 in the vicinity of the bottom portion of the case 51. Since the external suction pipes 41*a*, 42*a*, and 43*a* are in contact with air, the external suction pipes 41*a*, 42*a*, and 43*a* are formed of a copper material or the like having corrosion resistance. Since the internal suction pipes 41*b*, 42*b*, and 43*b* are not in contact with air, the internal suction pipes 41*b*, 42*b*, and 43*b* are formed of a low-cost steel material or the like. Further, the external suction pipes 41*a*, 42*a*, and 43*a* and the internal suction pipes 41*b*, 42*b*, and 43*b* may be integrally formed of the same material.

The internal suction pipes 41*b*, 42*b*, and 43*b* each have a straight central axis. The central axes of the internal suction pipes 41*b*, 42*b*, and 43*b* are disposed parallel to the central axis of the case 51 of the accumulator 50. End portions of the internal suction pipes 41*b*, 42*b*, and 43*b* in the +Z direction open inside the case 51. Outflow holes 49 of a liquid refrigerant are formed in lower portions of the internal suction pipes 41*b*, 42*b*, and 43*b*. The liquid refrigerant accumulated in the lower portion of the case 51 flows out of the outflow holes 49 little by little to the internal suction pipes 41*b*, 42*b*, and 43*b* in addition to being evaporated inside the case 51.

End portions of the external suction pipes 41*a*, 42*a*, and 43*a* in the −Z direction are curved toward the compressor main body 10. The end portions of the external suction pipes 41*a*, 42*a*, and 43*a* in the −Z direction are respectively connected to the three suction ports 26, 27, and 28 of the compressor main body 10 to communicate with the suction holes 38 of the cylinder 35. That is, the first suction pipe 41 is connected to the suction hole 38 of the cylinder 35 of the first compression mechanism unit 21 through the first suction port 26 and is brazed to the first suction port 26 outside the case 11. The second suction pipe 42 is connected to the suction hole 38 of the cylinder 35 of the second compression mechanism unit 22 through the second suction port 27 and is brazed to the second suction port 27 outside the case 11. The third suction pipe 43 is connected to the suction hole 38 of the cylinder 35 of the third compression mechanism unit 23 through the third suction port 28 and is brazed to the third suction port 28 outside the case 11.

Figure 2:
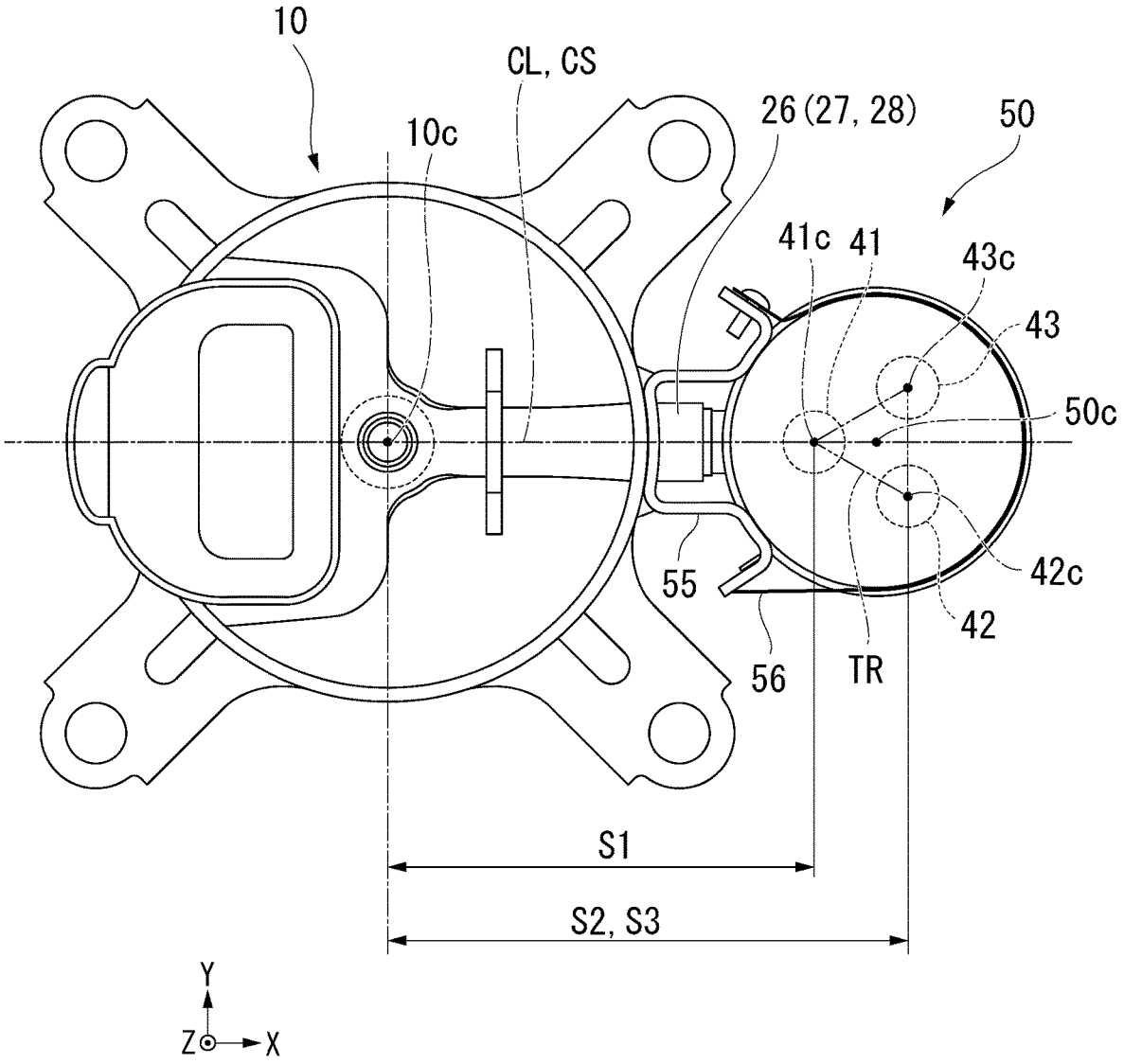
FIG. 2 is a plan view of the compressor of the first embodiment.
Figure 3:
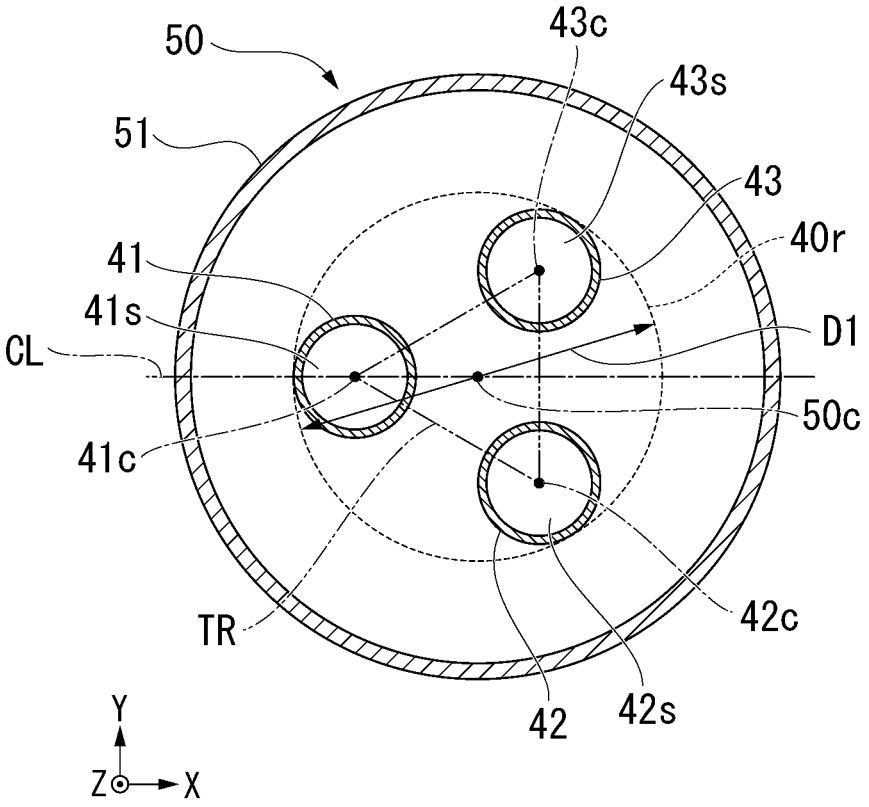
FIG. 3 is a cross-sectional view along line F3-F3 in FIG. 1.

FIG. 2 is a plan view of the compressor 2 of the first embodiment. FIG. 3 is a cross-sectional view along line F3-F3 in FIG. 1. FIG. 3 illustrates a cross section of a portion in which the three suction pipes 41, 42, and 43 penetrate the bottom portion of the case 51 of the accumulator 50. A first center 41*c* of a first flow path cross section 41*s* of the first suction pipe 41, a second center 42*c* of a second flow path cross section 42*s* of the second suction pipe 42, and a third center 43*c* of a third flow path cross section 43*s* of the third suction pipe 43 are defined as illustrated in FIG. 3. The first center 41*c*, the second center 42*c*, and the third center 43*c* are positioned at vertices of a triangle TR when viewed from the +Z direction. Thereby, the three suction pipes 41, 42, and 43 are disposed close to each other compared to a case in which the three suction pipes 41, 42, and 43 are disposed to be aligned in a line when viewed from the +Z direction. Therefore, the accumulator 50 is made compact. In the example of FIG. 3, the triangle TR is an equilateral triangle. All interior angles of the triangle TR are less than 90 degrees (acute angles). Thereby, the three suction pipes 41, 42, and 43 are disposed close to each other compared to a case in which one interior angle of the triangle TR is 90 degrees or more (an obtuse angle). Therefore, the accumulator 50 is made compact.

When the accumulator 50 is made compact, components for an accumulator having two suction pipes can be used for components of the accumulator 50.

The compressor main body 10 vibrates in accordance with eccentric rotation of the eccentric part 32 and the roller 33. When the accumulator 50 is made compact, a distance between a center 10*c* of the compressor main body 10 and a center 50*c* of the accumulator 50 decreases as illustrated in FIG. 2. Thereby, vibrations of the accumulator 50 according to the vibrations of the compressor main body 10 are suppressed.

A first distance S1 between the first center 41*c* and the center 10*c* of the compressor main body 10, a second distance S2 between the second center 42*c* and the center 10*c* of the compressor main body 10, and a third distance S3 between the third center 43*c* and the center 10*c* of the compressor main body 10 are defined as illustrated in FIG. 2. The first distance S1 is smaller than the second distance S2 and the third distance S3. In other words, the first suction pipe 41 is disposed closer to the compressor main body 10 than the second suction pipe 42 and the third suction pipe 43 are. In the example of FIG. 2, the second distance S2 and the third distance S3 are equal.

As illustrated in FIG. 2, a center connection line CL is defined as a straight line passing through the center 10*c* of the compressor main body 10 and the center 50*c* of the accumulator 50. Also, a center connection plane CS is defined as an XZ plane including the center connection line CL. In other words, the center connection plane CS is a plane including the central axis of the compressor main body 10 and the central axis of the accumulator 50.

The first suction pipe 41 is disposed to satisfy the following. As illustrated in FIG. 3, when viewed from the +Z direction, the first flow path cross section 41*s* of the first suction pipe 41 overlaps the center connection line CL. In other words, the first flow path cross section 41*s* of the first suction pipe 41 intersects the center connection plane CS. At least a part of the first flow path cross section 41*s* may overlap the center connection line CL. For example, an outer circumference of the first flow path cross section 41*s* may be in contact with the center connection line CL. The first flow path cross section 41*s* in this case overlaps the center connection line CL at a point. In the example of FIG. 3, the first center 41*c* of the first flow path cross section 41*s* of the first suction pipe 41 is disposed on the center connection line CL. The first flow path cross section 41*s* in this case overlaps the center connection line CL along a line by a length of a diameter of the first flow path cross section 41*s*.

The second suction pipe 42 and the third suction pipe 43 are disposed to satisfy the following. As illustrated in FIG. 3, when viewed from the +Z direction, the second flow path cross section 42*s* of the second suction pipe 42 and the third flow path cross section 43*s* of the third suction pipe 43 are positioned on opposite sides of the center connection line CL (or the center connection plane CS) sandwiched therebetween. In the example of FIG. 3, the second flow path cross section 42*s* is positioned in the −Y direction of the center connection line CL, and the third flow path cross section 43*s* is positioned in the +Y direction of the center connection line CL. A second separation distance from the second flow path cross section 42*s* to the center connection line CL may be different from a third separation distance from the third flow path cross section 43*s* to the center connection line CL. In the example of FIG. 3, the second separation distance and the third separation distance are the same. In the example of FIG. 3, the triangle TR is line-symmetric with respect to the center connection line CL.

As illustrated in FIG. 1, an end portion of the first suction pipe 41 in the −Z direction is connected to the first suction port 26 which is at an uppermost position in the +Z direction among the three suction ports 26, 27, and 28. An end portion of the third suction pipe 43 in the −Z direction is connected to the third suction port 28 which is at a lowermost position in the −Z direction. An end portion of the second suction pipe 42 in the −Z direction is connected to the second suction port 27 positioned in the middle in the Z direction.

Figure 4:
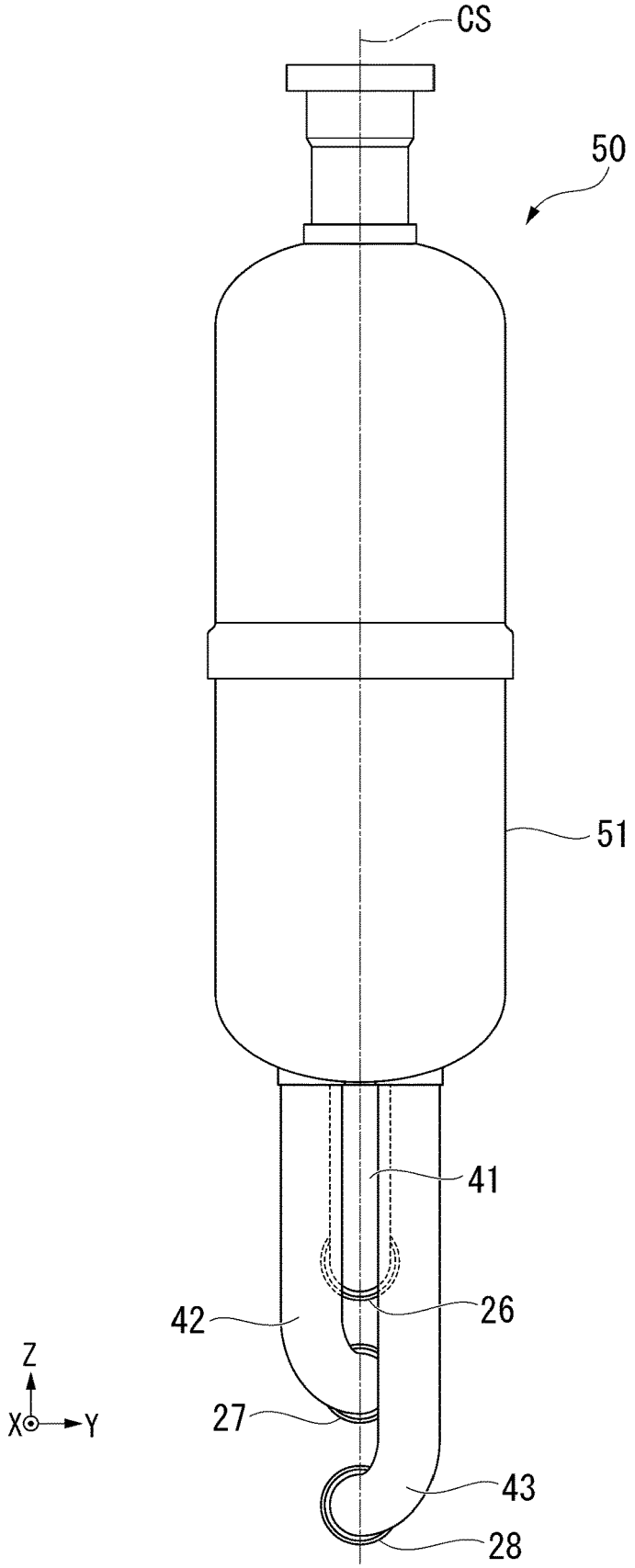
FIG. 4 is a side view of an accumulator.

FIG. 4 is a side view of the accumulator 50 from an F4 direction in FIG. 1. As illustrated in FIG. 4, the three suction ports 26, 27, and 28 are disposed at the same position when viewed from the +Z direction. In other words, the three suction ports 26, 27, and 28 are disposed on a straight line parallel to the Z direction. When viewed from the +Z direction, the three suction ports 26, 27, and 28 overlap the center connection line CL. In other words, the three suction ports 26, 27, and 28 intersect the center connection plane CS. That is, the three suction ports 26, 27, and 28 open in the same direction. Thus, the three suction pipes 41, 42, and 43 are connected to the three suction ports 26, 27, and 28 from the same direction. Therefore, connection work of the three suction pipes 41, 42, and 43 is simplified.

As illustrated in FIG. 4, the end portion of the first suction pipe 41 in the −Z direction extends in the −Z direction from the case 51 while intersecting the center connection plane CS. Further, the end portion of the first suction pipe 41 in the −Z direction is connected to the first suction port 26 while intersecting the center connection plane CS. The end portion of the second suction pipe 42 in the −Z direction, in the −Y direction of the center connection plane CS, extends in the −Z direction from the case 51. Further, the end portion of the second suction pipe 42 in the −Z direction is curved in the +Y direction toward the center connection plane CS to be connected to the second suction port 27. The end portion of the third suction pipe 43 in the −Z direction, in the +Y direction of the center connection plane CS, extends in the −Z direction from the case 51. Further, the end portion of the third suction pipe 43 in the −Z direction is curved in the −Y direction toward the center connection plane CS to be connected to the third suction port 28.

As described above, the first suction pipe 41 has the following configuration. The first suction pipe 41 is disposed closer to the compressor main body 10 than the second suction pipe 42 and the third suction pipe 43 are. When viewed from the +Z direction, the first flow path cross section 41*s* of the first suction pipe 41 overlaps the center connection line CL. The first suction pipe 41 is connected to the first suction port 26 which is at the uppermost position among the three suction ports 26, 27, and 28. When viewed from the +Z direction, the first suction port 26 overlaps the center connection line CL.

Thereby, a length of the first suction pipe 41 decreases. Therefore, heat loss of a gaseous refrigerant flowing through the first suction pipe 41 decreases, improving efficiency of the compressor 2. Also, as illustrated in FIG. 1, the first suction pipe 41 has a simple shape that is curved only two-dimensionally. Therefore, material costs and processing costs of the first suction pipe 41 are suppressed.

The second suction pipe 42 and the third suction pipe 43 have the following configuration. The second suction pipe 42 and the third suction pipe 43 are disposed farther from the compressor main body 10 than the first suction pipe 41 is. When viewed from the +Z direction, the second flow path cross section 42*s* of the second suction pipe 42 and the third flow path cross section 43*s* of the third suction pipe 43 are positioned on opposite sides of the center connection line CL sandwiched therebetween. The third suction pipe 43 is connected to the third suction port 28 of the third compression mechanism unit 23 which is at the lowermost position. The second suction pipe 42 is connected to the second suction port 27 of the second compression mechanism unit 22 positioned in the middle in the Z direction. When viewed from the +Z direction, the second suction port 27 and the third suction port 28 overlap the center connection line CL.

Thereby, as illustrated in FIG. 4, the second suction pipe 42 and the third suction pipe 43 have a three-dimensionally curved shape. Even in this case, since the second suction pipe 42 and the third suction pipe 43 are disposed far from the compressor main body 10, curved shapes thereof are gently and smoothly realized. Also, since the second suction pipe 42 and the third suction pipe 43 are positioned on opposite sides of the center connection line CL sandwiched therebetween, lengths thereof are not unnecessarily large. Therefore, material costs and processing costs of the second suction pipe 42 and the third suction pipe 43 are suppressed.

Figure 5:
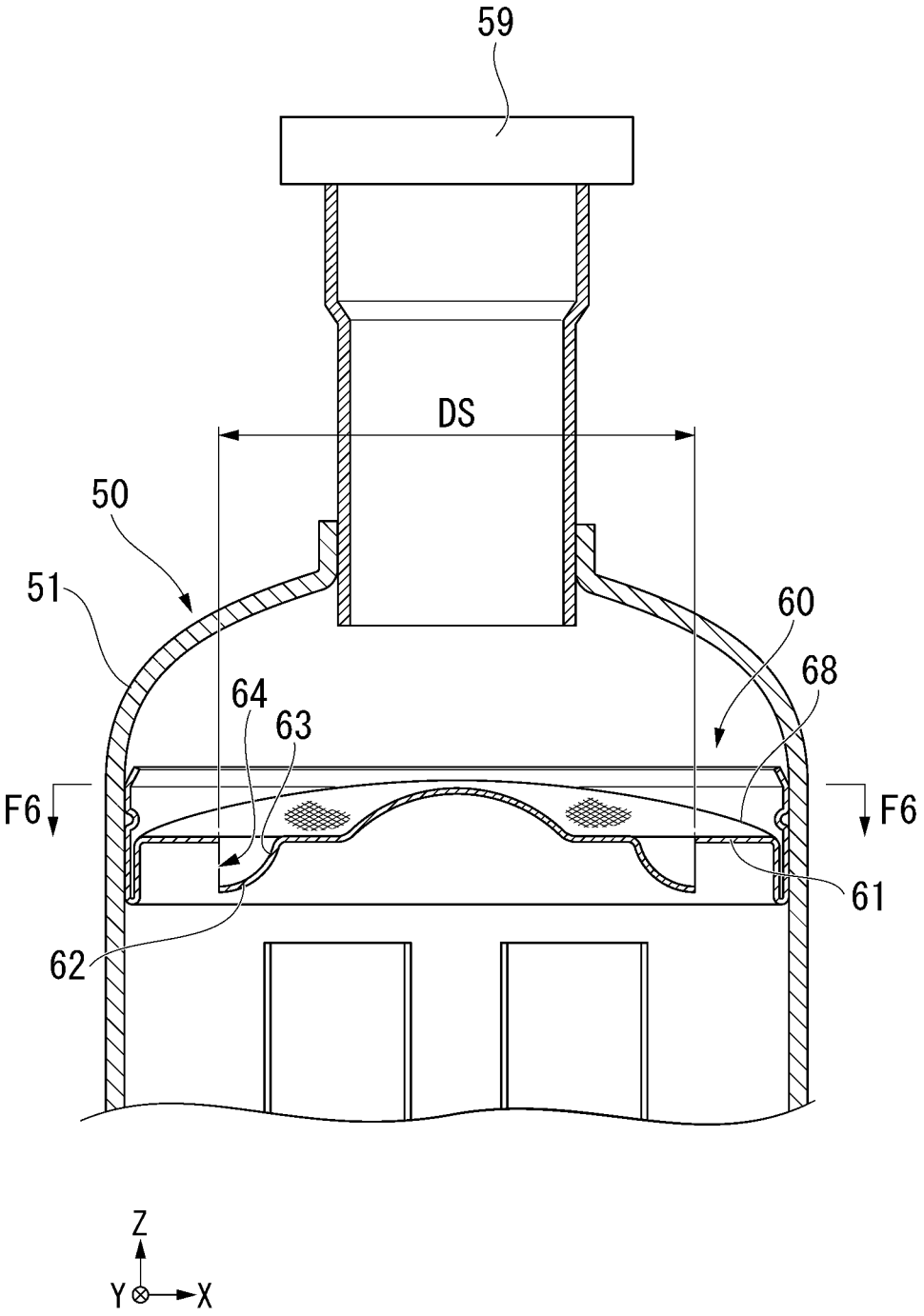
FIG. 5 is an enlarged view of a portion F5 in FIG. 1.
Figure 6:
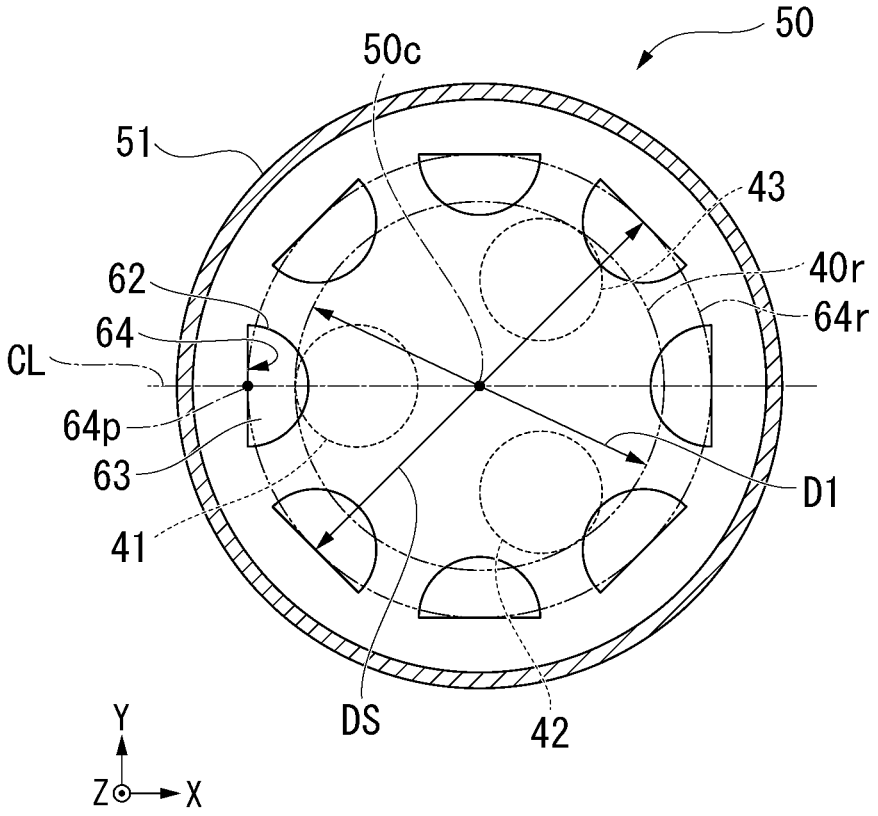
FIG. 6 is a cross-sectional view along line F6-F6 in FIG. 5.

FIG. 5 is an enlarged view of a portion F5 in FIG. 1. FIG. 6 is a cross-sectional view along line F6-F6 in FIG. 5. In FIG. 6, illustration of a net member 68 is omitted.

As illustrated in FIG. 5, the strainer plate 60 is disposed in the +Z direction inside the case 51. An outer circumferential surface of the strainer plate 60 is fixed to the inner circumferential surface of the case 51.

The strainer plate 60 includes a plate main body 61 and the net member 68. The net member 68 is disposed in the +Z direction of the plate main body 61. The net member 68 captures foreign substances contained in the refrigerant introduced from the introduction part 59.

The plate main body 61 is formed in a disc shape using a steel plate material or the like. The plate main body 61 includes a rectifying part 62. The rectifying part 62 is formed at an intermediate portion in a radial direction of the plate main body 61. The rectifying part 62 is formed to be recessed in the −Z direction from the plate main body 61. A surface of the rectifying part 62 in the +Z direction is an inclined surface 63 which is inclined in the −Z direction outward in the radial direction of the plate main body 61. An opening 64 is formed at an end portion of the rectifying part 62 on a radially outward side of the plate main body 61. The opening 64 opens outward in the radial direction of the plate main body 61. The rectifying part 62 rectifies the refrigerant introduced from the introduction part 59 outward in the radial direction of the plate main body 61.

As illustrated in FIG. 6, the plate main body 61 includes a plurality of rectifying parts 62. The plurality of rectifying parts 62 are formed at equiangular intervals in the circumferential direction of the plate main body 61.

In the opening 64 of the rectifying part 62, a point positioned on an innermost side in the radial direction of the plate main body 61 is defined as an innermost point 64*p*. A center of an innermost circle 64*r* including the innermost points 64*p* of the plurality of rectifying parts 62 coincides with the center 50*c* of the accumulator 50. On the other hand, a center of a circumscribed circle 40*r* circumscribing the three suction pipes 41, 42, and 43 inside the case 51 also coincides with the center 50*c* of the accumulator 50. A diameter DS of the innermost circle 64*r* of the opening 64 of the rectifying part 62 is larger than a diameter D1 of the circumscribed circle 40*r* of the three suction pipes 41, 42, and 43. Thus, even when a liquid refrigerant that has passed through the opening 64 falls in the −Z direction, the liquid refrigerant does not flow into the three suction pipes 41, 42, and 43. Therefore, gas-liquid separation performance of the accumulator 50 is improved.

As described in detail above, the compressor 2 of the present embodiment has the following configuration. The compressor 2 includes the three suction pipes 41, 42, and 43. The first center 41*c* of the first suction pipe 41, the second center 42*c* of the second suction pipe 42, and the third center 43*c* of the third suction pipe 43 are positioned at vertices of the triangle TR. The first distance S1 between the first center 41*c* and the center 10*c* of the compressor main body 10 is smaller than the second distance S2 between the second center 42*c* and the center 10*c* of the compressor main body 10 and the third distance S3 between the third center 43*c* and the center 10*c* of the compressor main body 10. The first flow path cross section 41*s* of the first suction pipe 41 overlaps the center connection line CL passing through the center 10*c* of the compressor main body 10 and the center 50*c* of the accumulator 50. The second flow path cross section 42*s* of the second suction pipe 42 and the third flow path cross section 43*s* of the third suction pipe 43 are positioned on opposite sides of the center connection line CL sandwiched therebetween. The first suction pipe 41 is connected to the first suction port 26 which is at the uppermost position among the three suction ports 26, 27, and 28.

Since the first center 41*c*, the second center 42*c*, and the third center 43*c* are positioned at vertices of the triangle TR, the three suction pipes 41, 42, and 43 are disposed close to each other. Therefore, the accumulator 50 is made compact. Also, a length of the first suction pipe 41 decreases, and the shape is simplified. Therefore, material costs and processing costs of the first suction pipe 41 are suppressed. Also, lengths of the second suction pipe 42 and the third suction pipe 43 are not unnecessarily large, and curved shapes thereof are gently and smoothly realized. Therefore, material costs and processing costs of the second suction pipe 42 and the third suction pipe 43 are suppressed.

The three suction pipes 41, 42, and 43 are disposed such that all the interior angles of the triangle TR are less than 90 degrees. Thereby, the accumulator 50 is made compact.

The three suction ports 26, 27, and 28 are disposed to overlap the center connection line CL when viewed from above the accumulator 50. Thus, the three suction pipes 41, 42, and 43 are connected to the three suction ports 26, 27, and 28 from the same direction. Therefore, connection work of the three suction pipes 41, 42, and 43 is simplified.

Second Embodiment

A compressor 202 according to a second embodiment will be described.

Figure 7:
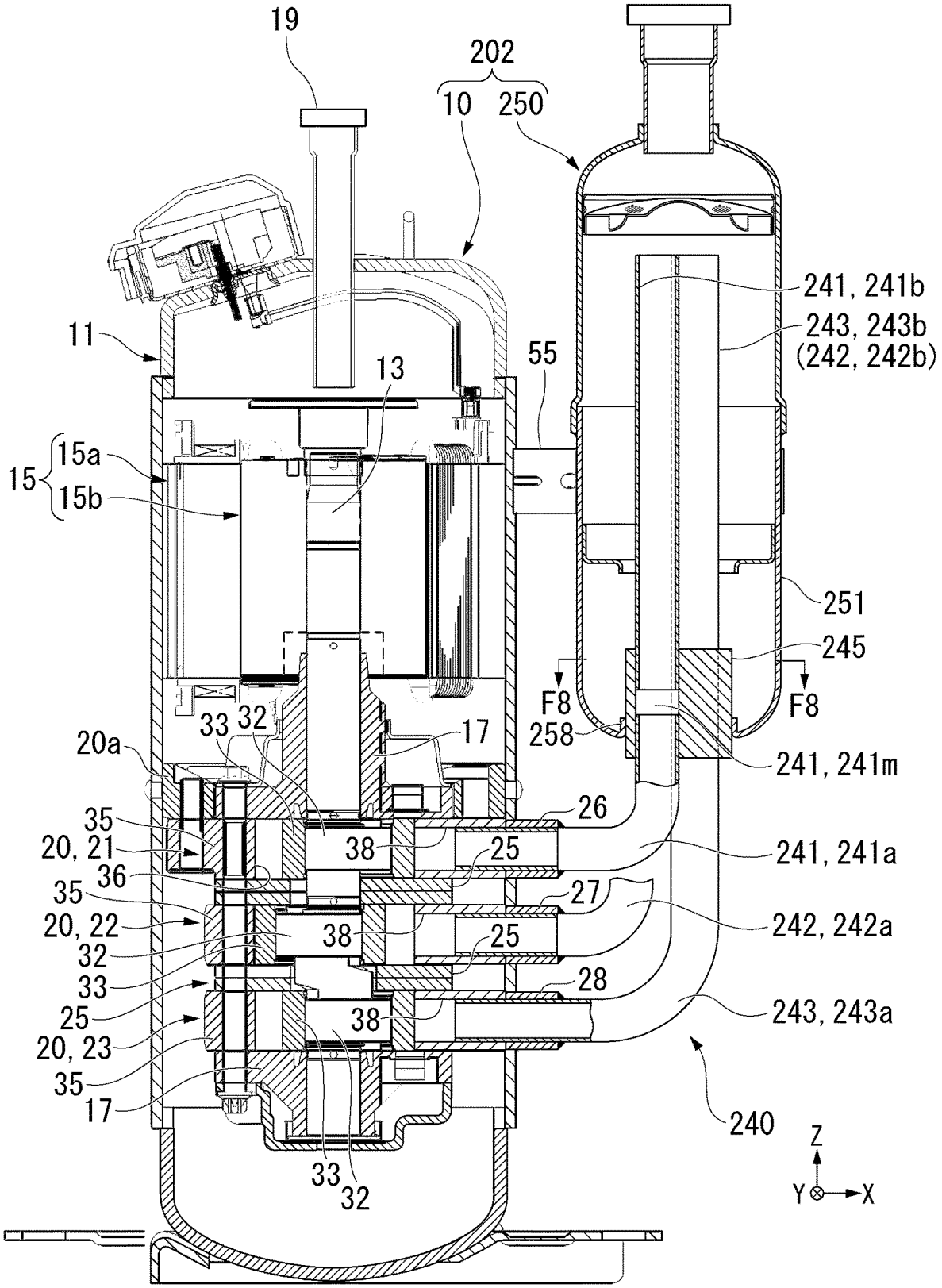
FIG. 7 is a cross-sectional view of a compressor of a second embodiment.

FIG. 7 is a cross-sectional view of the compressor 202 of the second embodiment. The compressor 202 according to the second embodiment is different from the compressor 2 according to the first embodiment in that the compressor 202 includes a columnar member 245. Description of the compressor 202 will be omitted for portions the same as those in the compressor 2.

The compressor 202 includes an accumulator 250. The accumulator 250 includes a case 251, a plurality of suction pipes 240, and a columnar member 245. The plurality of suction pipes 240 are three suction pipes including a first suction pipe 241, a second suction pipe 242, and a third suction pipe 243. The three suction pipes 241, 242, and 243 include external suction pipes 241*a*, 242*a*, and 243*a* and internal suction pipes 241*b*, 242*b*, and 243*b*.

As illustrated in FIG. 7, the columnar member 245 is disposed to pass through a through hole 258 formed in a bottom portion of the case 251.

Figure 8:
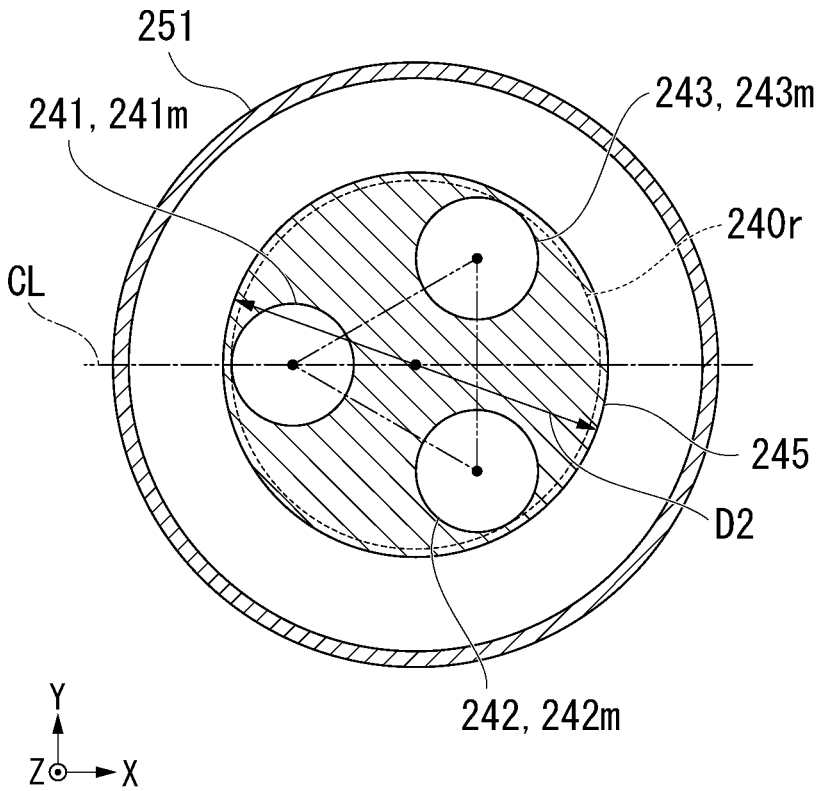
FIG. 8 is a cross-sectional view along line F8-F8 in FIG. 7.

FIG. 8 is a cross-sectional view along line F8-F8 in FIG. 7. FIG. 8 illustrates a cross section of a portion in which the columnar member 245 penetrates the bottom portion of the case 251. As illustrated in FIGS. 7 and 8, an outer shape of the columnar member 245 is formed in a columnar shape. The columnar member 245 has three columnar member suction passages 241*m*, 242*m*, and 243*m*. The columnar member suction passages 241*m*, 242*m*, and 243*m* penetrate the columnar member 245 in the Z direction. Central axes of the columnar member suction passages 241*m*, 242*m*, and 243*m* are parallel to the Z direction. The three columnar member suction passages 241*m*, 242*m*, 243*m* constitute a part of the three suction pipes 241, 242, and 243. As illustrated in FIG. 7, the external suction pipe 241*a* is connected to an end portion of the columnar member suction passage 241*m* in the −Z direction. The internal suction pipe 241*b* is connected to an end portion of the columnar member suction passage 241*m* in the +Z direction. The first suction pipe 241 is formed by the external suction pipe 241*a*, the columnar member suction passage 241*m*, and the internal suction pipe 241*b*. The same applies to the second suction pipe 242 and the third suction pipe 243.

In the first embodiment illustrated in FIG. 1, the three through holes 58 through which the three suction pipes 41, 42, and 43 penetrate are formed in the bottom portion of the case 51. At this time, it is necessary to prevent deformation of the case 51 between the three through holes 58 and to secure pressure resistance of the accumulator 50. Therefore, the three suction pipes 41, 42, and 43 are disposed to be spaced apart from each other. Therefore, there is a limit to reducing the diameter D1 of the circumscribed circle 40*r* circumscribing the three suction pipes 41, 42, and 43 as illustrated in FIG. 3.

In contrast, in the second embodiment illustrated in FIG. 7, only one through hole 258 through which the columnar member 245 penetrates is formed in the bottom portion of the case 251. At this time, since there is no need to consider deformation of the case 251, the three suction pipes 241, 242, and 243 are disposed close to each other. Therefore, as illustrated in FIG. 8, a diameter D2 of the columnar member 245 is small. The diameter D2 of the columnar member 245 in FIG. 8 is smaller than the diameter D1 of the circumscribed circle 40*r* in FIG. 3. Further, a diameter of a circumscribed circle 240*r* circumscribing the three suction pipes 241, 242, and 243 in FIG. 8 is also smaller than the diameter D1 of the circumscribed circle 40*r* in FIG. 3. Thus, the accumulator 250 is made compact.

A compressor 302 of a first modified example of the second embodiment will be described.

Figure 9:
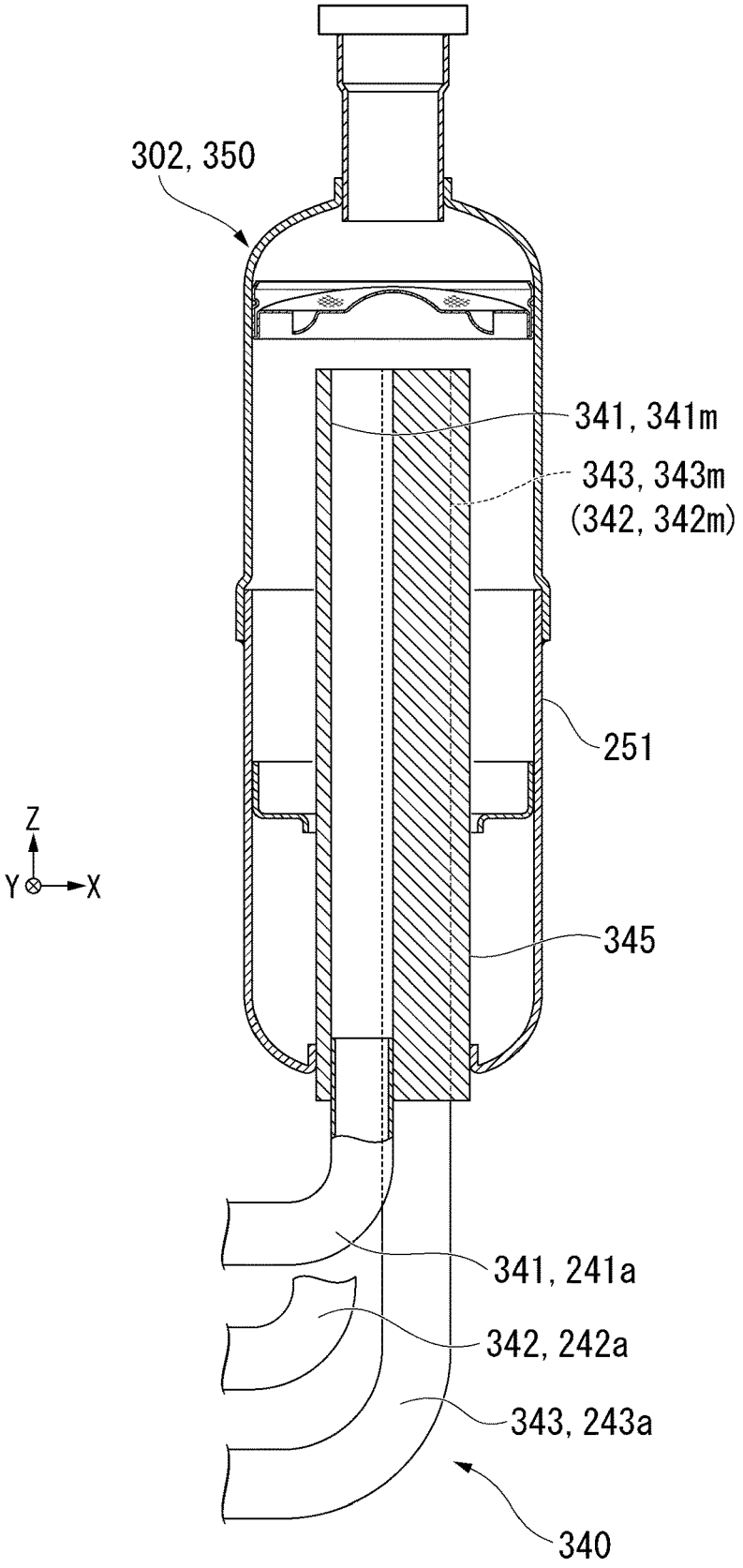
FIG. 9 is a cross-sectional view of an accumulator in a compressor of a first modified example of the second embodiment.

FIG. 9 is a cross-sectional view of an accumulator 350 in the compressor 302 of the first modified example of the second embodiment. Description of the compressor 302 will be omitted for portions the same as those in the compressor 202 of the second embodiment.

The compressor 302 includes the accumulator 350. The accumulator 350 includes a plurality of suction pipes 340 and a columnar member 345. The plurality of suction pipes 340 are three suction pipes including a first suction pipe 341, a second suction pipe 342, and a third suction pipe 343. The columnar member 345 includes three columnar member suction passages 341*m*, 342*m*, and 343*m*.

The columnar member 345 penetrates a bottom portion of the case 251 and extends to an upper portion of the case 251. The three columnar member suction passages 341*m*, 342*m*, and 343*m* open at an upper end portion of the columnar member 345. The three suction pipes 341, 342, and 343 are formed by the external suction pipes 241*a*, 242*a*, and 243*a* and the columnar member suction passages 341*m*, 342*m*, and 343*m*. The columnar member suction passages 341*m*, 342*m*, and 343*m* also serve as the internal suction pipes 241*b*, 242*b*, and 243*b* illustrated in FIG. 7. Thus, the internal suction pipes 241*b*, 242*b*, and 243*b* are eliminated.

A compressor 402 of a second modified example of the second embodiment will be described.

Figure 10:
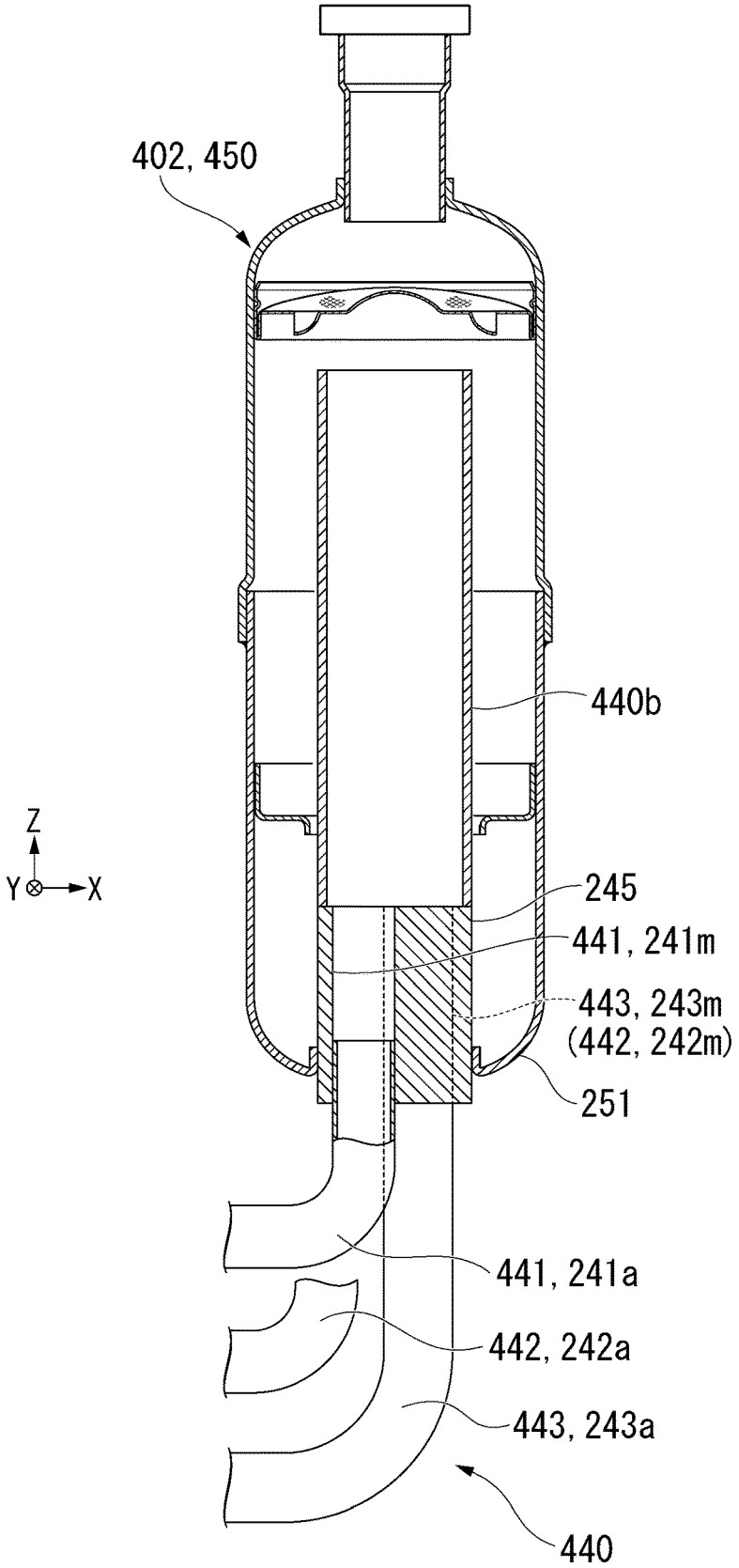
FIG. 10 is a cross-sectional view of an accumulator in a compressor of a second modified example of the second embodiment.

FIG. 10 is a cross-sectional view of an accumulator 450 in the compressor 402 of the second modified example of the second embodiment. Description of the compressor 402 will be omitted for portions the same as those in the compressor 202 of the second embodiment.

The compressor 402 includes the accumulator 450. The accumulator 450 includes a plurality of suction pipes 440. The plurality of suction pipes 440 are three suction pipes including a first suction pipe 441, a second suction pipe 442, and a third suction pipe 443.

The accumulator 450 of the present modified example includes the same columnar member 245 as in the second embodiment. A cylindrical common suction pipe 440*b* is connected to an end portion of the columnar member 245 in the +Z direction. An outer diameter of the common suction pipe 440*b* is formed, for example, to be equal to an outer diameter of the columnar member 245. Upper end portions of the columnar member suction passages 241*m*, 242*m*, and 243*m* open inside the common suction pipe 440*b*. A central axis of the common suction pipe 440*b* of the columnar member 245 is parallel to the Z direction. The common suction pipe 440*b* extends to an upper portion of the case 251. An upper end portion of the common suction pipe 440*b* opens inside the case 251. The three suction pipes 441, 442, and 443 are formed by the external suction pipes 241*a*, 242*a*, and 243*a*, the columnar member suction passages 241*m*, 242*m*, and 243*m*, and the common suction pipe 440*b*. The common suction pipe 440*b* also serves as the internal suction pipes 241*b*, 242*b*, and 243*b* illustrated in FIG. 7. Thus, the internal suction pipes 241*b*, 242*b*, and 243*b* are eliminated.

The compressor of the embodiment includes three compression mechanism units for three suction pipes. The compressor may include four or more compression mechanism units for three suction pipes. In this case, a suction hole communicating with a pair of compression mechanism units is formed in a partition plate that partitions the pair of compression mechanism units, and a suction pipe is connected to the suction hole.

According to at least any one embodiment described above, as illustrated in FIG. 1, the first center 41*c* of the first suction pipe 41, the second center 42*c* of the second suction pipe 42, and the third center 43*c* of the third suction pipe 43 are positioned at vertices of the triangle TR when viewed from the +Z direction. The first distance S1 between the first center 41*c* and the center 10*c* of the compressor main body 10 is smaller than the second distance S2 between the second center 42*c* and the center 10*c* and the third distance S3 between the third center 43*c* and the center 10*c*. The first suction pipe 41 overlaps the center connection line CL, and the second suction pipe 42 and the third suction pipe 43 are positioned on opposite sides of the center connection line CL sandwiched therebetween. An end portion of the first suction pipe 41 in the −Z direction is connected to the first suction port 26 which is at the uppermost position. Thereby, the accumulator 50 is made compact.

While certain embodiments have been described, these embodiments have been presented by way of example only, and are not intended to limit the scope of the inventions. Indeed, the novel embodiments described herein may be embodied in a variety of other fat its; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A compressor, comprising:

a compressor main body which houses a plurality of compression mechanism units and an electric motor unit driving the plurality of compression mechanism units in a case;

an accumulator supported by the compressor main body and including a refrigerant introduction part at an upper portion thereof; and three suction pipes penetrating a bottom portion of the accumulator, having one end sides which open inside the accumulator, and having each of the other end sides connected to a corresponding suction port of three suction ports provided in the case, wherein the three suction pipes are a first suction pipe, a second suction pipe, and a third suction pipe, the three suction pipes are disposed so that a first center of a first flow path cross section of the first suction pipe, a second center of a second flow path cross section of the second suction pipe, and a third center of a third flow path cross section of the third suction pipe are positioned at vertices of a triangle in a portion penetrating the bottom portion of the accumulator when viewed from above the accumulator, the first suction pipe is disposed so that a first distance between the first center and a center of the compressor main body is smaller than a second distance between the second center and the center of the compressor main body and a third distance between the third center and the center of the compressor main body, the first suction pipe is disposed so that the first flow path cross section overlaps a center connection line passing through the center of the compressor main body and a center of the accumulator when viewed from above the accumulator, the second suction pipe and the third suction pipe are disposed so that the second flow path cross section and the third flow path cross section are positioned on opposite sides of the center connection line sandwiched therebetween when viewed from above the accumulator, and the other end side of the first suction pipe is connected to a suction port which is at an uppermost position among the three suction ports.

2. The compressor according to claim 1, wherein the three suction pipes are disposed so that all interior angles of the triangle are less than 90 degrees.

3. The compressor according to claim 1, wherein the three suction ports are disposed to overlap the center connection line when viewed from above the accumulator.

4. The compressor according to claim 1, further comprising:

a columnar member penetrating the bottom portion of the accumulator, wherein the three suction pipes have three columnar member suction passages penetrating the columnar member.

5. The compressor according to claim 4, wherein the three suction pipes have three internal suction pipes disposed inside the accumulator, and the three internal suction pipes have one end sides opening inside the accumulator and the other end sides connected to the columnar member suction passages.

6. A refrigeration cycle device, comprising:

the compressor according to claim 1;

a radiator connected to the compressor;

an expansion device connected to the radiator; and a heat absorber connected to the expansion device.

* * * * *